US008079858B2

(12) United States Patent
Naito

(10) Patent No.: US 8,079,858 B2
(45) Date of Patent: Dec. 20, 2011

(54) LAMP CONNECTOR FOR A BACKLIGHT ASSEMBLY

(75) Inventor: Takeharu Naito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 99 days.

(21) Appl. No.: 12/459,219

(22) Filed: Jun. 29, 2009

(65) Prior Publication Data

US 2010/0002419 A1 Jan. 7, 2010

(30) Foreign Application Priority Data

Jul. 1, 2008 (JP) ..... 2008-171997
May 19, 2009 (JP) ..... 2009-120622

(51) Int. Cl.
*H01R 27/00* (2006.01)

(52) U.S. Cl. ..... 439/222; 439/239; 362/217.17

(58) Field of Classification Search ..... 439/222, 439/239, 226, 375, 541; 362/217.17, 225, 362/634

See application file for complete search history.

(56) References Cited

U.S. PATENT DOCUMENTS

| | | | |
|---|---|---|---|
| 6,589,076 | B1 | 7/2003 | Davis et al. |
| 7,473,117 | B2 | 1/2009 | Miyazono et al. |
| 7,553,176 | B2 | 6/2009 | Naito et al. |
| 7,607,805 | B2 | 10/2009 | Kwon et al. |
| 7,651,354 | B2 | 1/2010 | Kim |
| 2007/0218735 | A1* | 9/2007 | Miyazono et al. ..... 439/226 |
| 2007/0298662 | A1* | 12/2007 | Kim ..... 439/620.02 |

FOREIGN PATENT DOCUMENTS

| | | |
|---|---|---|
| CN | 101098063 | 1/2008 |
| JP | 2000-208199 | 7/2000 |
| JP | 2003-031319 | 1/2003 |
| JP | 2007-257881 | 10/2007 |
| JP | 2007-280955 | 10/2007 |
| JP | 2007-317545 | 12/2007 |
| JP | 2008-130271 | 6/2008 |
| KR | 10-2008-0055096 | 6/2008 |

OTHER PUBLICATIONS

Korean Office Action dated Jan. 21, 2011 with English translation of same.
Japanese Office Action dated Jun. 3, 2010 with English translation of same.
Chinese Office Action dated Jun. 15, 2011 in Chinese Application No. CN 200910150994.4 with English translation of same.

* cited by examiner

*Primary Examiner* — Vanessa Girardi
(74) *Attorney, Agent, or Firm* — Collard & Roe, P.C.

(57) ABSTRACT

A connector is configured to hold a lamp extending in a first direction. The connector includes a housing and a terminal. The terminal includes a first connection portion configured to establish connection with a lamp contact portion formed on the lamp, a second connection portion including a first contact and a second contact located at different positions in a second direction perpendicular to the first direction, and a fixed portion pressed in the housing along the second direction and located between the first connection portion and the second connection portion in the second direction.

17 Claims, 9 Drawing Sheets

LAMP CONNECTOR FOR A BACKLIGHT ASSEMBLY

CROSS REFERENCE TO RELATED APPLICATIONS

Applicant claims priority under 35 U.S.C. §119 of Japanese Patent Application No. JP2008-171997 filed Jul. 1, 2008 and Japanese Patent Application No. JP2009-120622 filed May 19, 2009.

BACKGROUND OF THE INVENTION

The present invention relates to a connector for connecting a fluorescent tube (fluorescent lamp) or a cold cathode fluorescent lamp (CCFL) to a substrate in a backlight unit of a liquid crystal panel.

For example, this type of connectors is disclosed by JP-A 2007-257881 and JP-A 2007-317545.

SUMMARY OF THE INVENTION

An object of the present invention is to provide a connector that is advantageous in versatility over conventional connectors.

According to an aspect of the present invention, there is provided a connector configured to hold a lamp extending in a first direction. The connector includes a housing and a terminal. The terminal includes a first connection portion configured to establish connection with a lamp contact portion formed on the lamp, a second connection portion including a first contact and a second contact located at different positions in a second direction perpendicular to the first direction, and a fixed portion pressed in the housing along the second direction and located between the first connection portion and the second connection portion in the second direction.

According to another aspect of the present invention, there is provided a backlight assembly having a lamp extending in a first direction, the aforementioned connector, and a substrate having a substrate contact portion connected to the first contact or the second contact of the connector.

An appreciation of the objectives of the present invention and a more complete understanding of its structure may be had by studying the following description of the preferred embodiment and by referring to the accompanying drawings.

Figure 1:
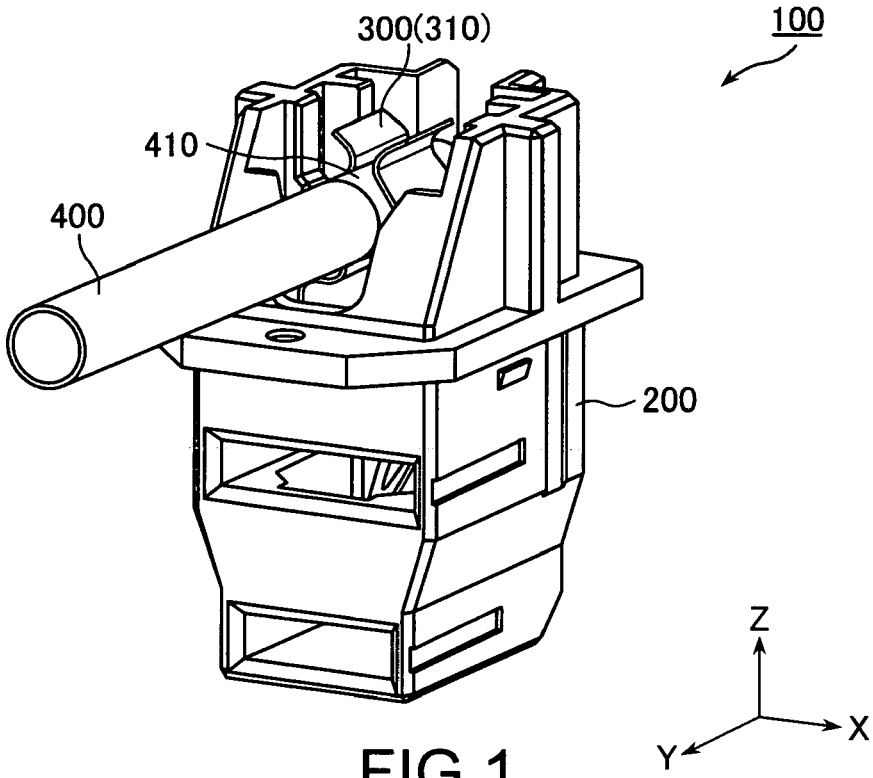
FIG. 1 is a perspective view showing a connector according to a first embodiment of the present invention, wherein a lamp is attached to the connector.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
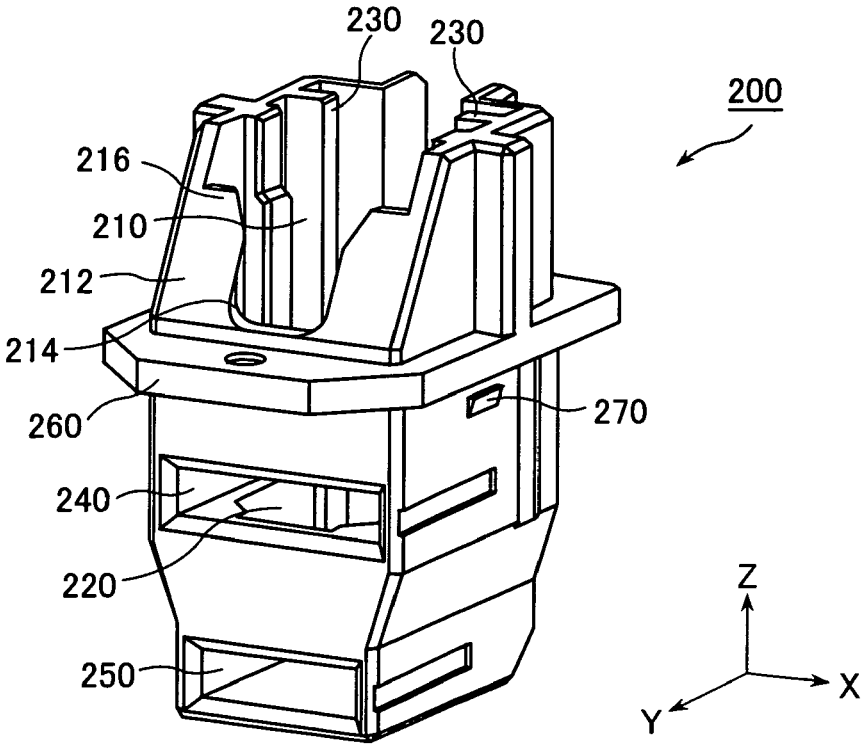
FIG. 2 is a perspective view showing a housing of the connector shown in FIG. 1.
Figure 3:
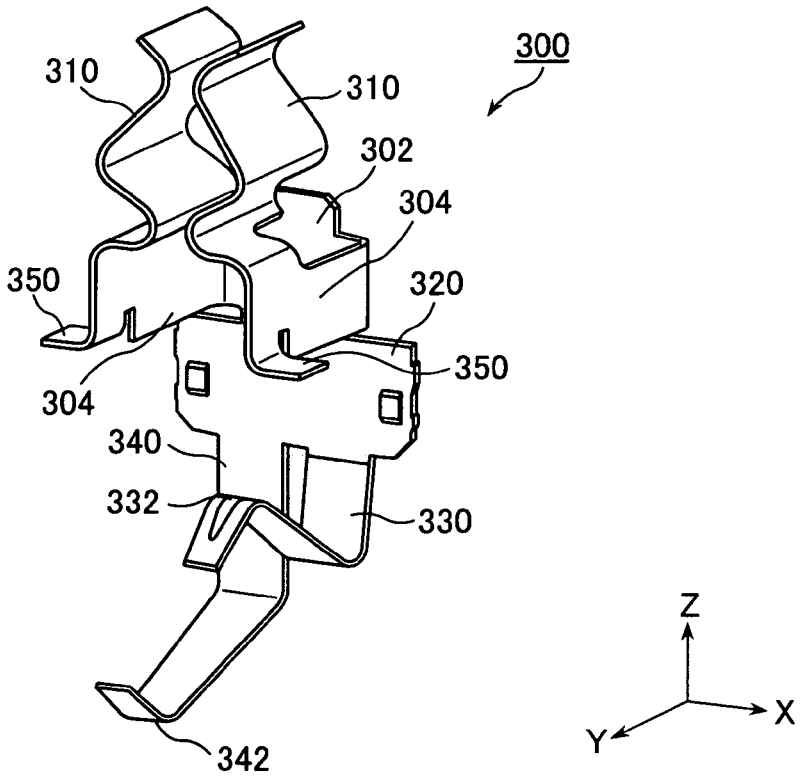
FIG. 3 is a perspective view showing a terminal of the connector shown in FIG. 1.

FIGS. 1 to 3 show a connector 100 according to a first embodiment of the present invention. As shown in FIGS. 1 to 3, the connector 100 is used to connect a lamp 400 to a substrate in a backlight unit of a liquid crystal panel. The connector 100 has a housing 200 formed of insulating resin and a terminal 300 held within the housing 200. The lamp 400 includes a lamp contact portion 410 such as a base or a metal-plated portion. The lamp 400 of the present embodiment comprises a cold cathode fluorescent lamp (CCFL).

The terminal 300 is configured to hold the lamp 400, which extends in the Y-direction (a first direction). The terminal 300 is formed of a base sheet metal. As shown in FIG. 3, the terminal 300 has a first connection portion 310 for establishing connection with the lamp contact portion 410 of the lamp 400, a fixed portion 320 extending in the Z-direction (a second direction), a first spring portion 330 extending from the fixed portion 320, and a second spring portion 340 extending from the fixed portion 320. The fixed portion 320 is pressed in and held within the housing 200.

Figure 4:
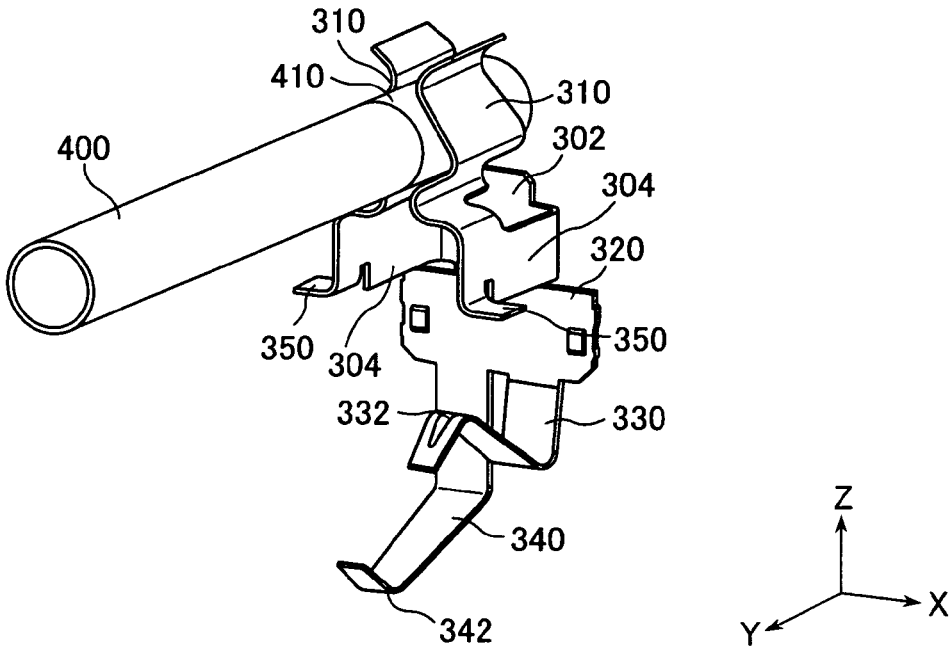
FIG. 4 is a perspective view showing the lamp held by the terminal shown in FIG. 3.

Specifically, the terminal 300 according to the present embodiment has a base portion 302 extending on the XZ-plane and a pair of arm portions 304 extending along the Y-direction from both ends of the base portion 302 in the X-direction (a third direction). The first connection portion 310 includes a pair of elastic members extending along the Z-direction from an end of each arm portion 304. The elastic members are opposed to each other in the X-direction and configured to hold the lamp contact portion 410 of the lamp 400 therebetween. Thus, the arm portion 304 and the elastic member of the first connection portion 310 form a spring having a shape resembling an L-shape as viewed along the X-direction. More specifically, the elastic members of the first connection portion 310 have ends slightly spreading outward in the X-direction for guiding the lamp 400. Thus, the first connection portion 310 has a vase-like shape as viewed along the Y-direction. As shown in FIG. 4, the terminal 300 according to the present embodiment can solely hold the lamp 400. Particularly, the first connection portion 310 is configured to have at least three contact points with the lamp contact portion 410 of the lamp 400.

The fixed portion 320 extends along the Z-direction from the base portion 302. The fixed portion 320 has projections formed on both ends thereof in the X-direction, so that the terminal 300 is unlikely to be pulled out of the housing 200 once the fixed portion 320 is pressed in the housing 200. Furthermore, lower corners of the fixed portion 320 are chamfered in order to facilitate incorporation of the terminal 300 into the housing 200. When the terminal 300 is incorporated into the housing 200, shoulders of the fixed portion 320, which are located near upper corners of the fixed portion 320 on its upper edge, are pushed downward.

The first spring portion 330 and the second spring portion 340 extend on an opposite side of the fixed portion 320 to the first connection portion 310 in the Z-direction. The fixed portion 320 is interposed between the first connection portion 310 and those spring portions 330 and 340. The first spring portion 330 has a first contact 332 provided thereon, and the second spring portion 340 has a second contact 342 provided thereon. The first contact 332 and the second contact 342 are located at different positions in the Z-direction. Specifically, a distance between the first contact 332 and the first connection portion 310 is different from a distance between the second contact 342 and the first connection portion 310. The first contact 332 and the second contact 342 form a second connection portion for establishing selectable connection with a substrate contact portion 520 formed on a substrate 500 as shown in FIG. 5D.

Figure 6:
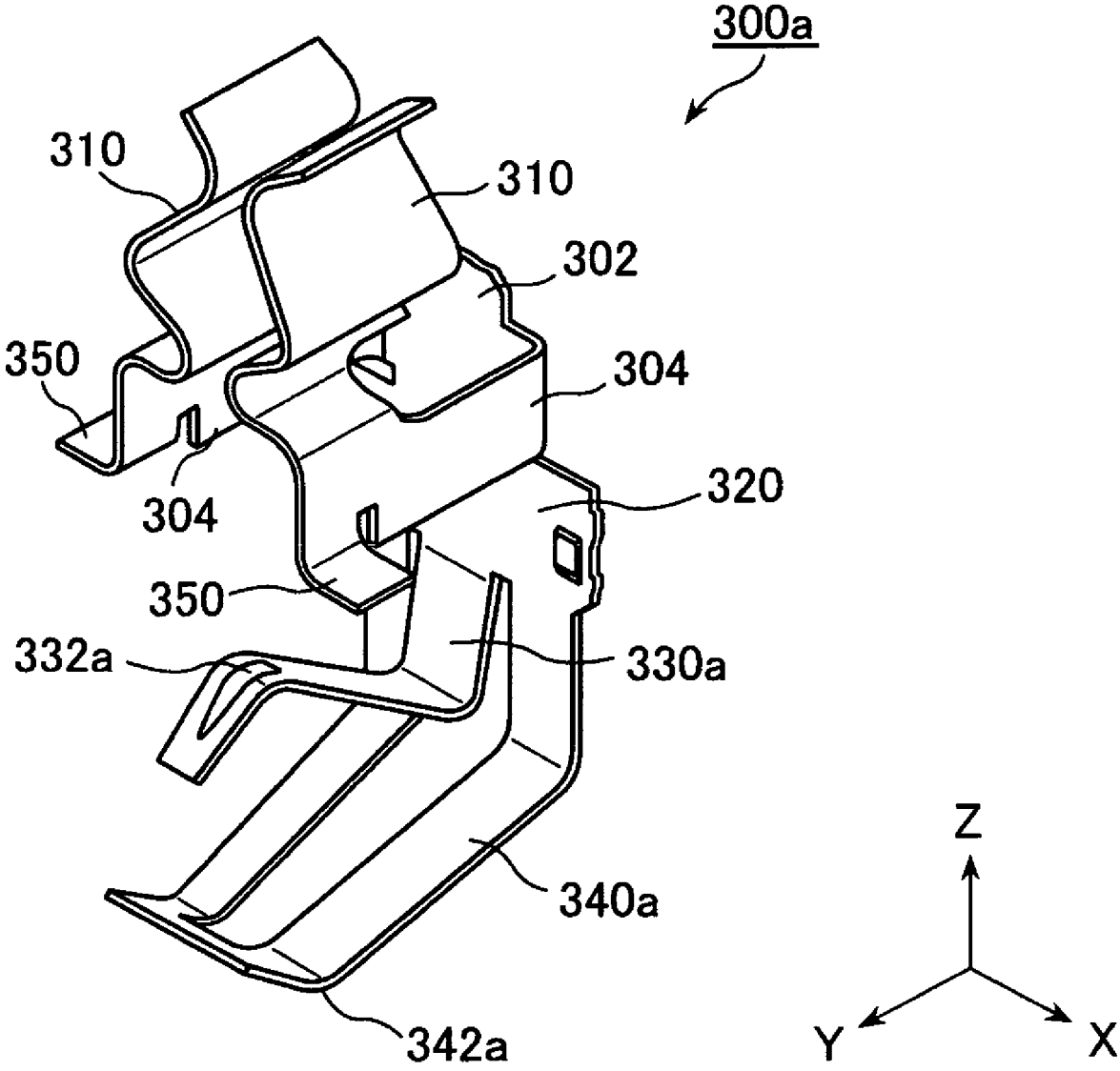
FIG. 6 is a perspective view showing a variation of the terminal shown in FIG. 3.

The illustrated first spring portion 330 is bent into a mountainous shape. The first contact 332 is located at the top of the mountainous shape. The second spring portion 340 is bent into a valley shape. The second contact 342 is located at the bottom of the valley shape. The first contact 332 can be brought into contact with the substrate contact portion 520 of the substrate 500 when the substrate contact portion 520 is formed on a lower surface of the substrate 500. The second contact 342 can be brought into contact with the substrate contact portion 520 of the substrate 500 when the substrate contact portion 520 is formed on an upper surface of the substrate 500. The present invention is not limited to this example. The spring portions 330 and 340 may have other forms depending upon the substrate 500 or the connection method. For example, the first spring portion 330 may be bent into a valley shape, and the first contact 332 may be located at the bottom of the valley shape. The second spring portion 340 may be bent into a mountainous shape, and the second contact 342 may be located at the top of the mountainous shape. Furthermore, the terminal may be modified as shown in FIG. 6. In the example of the terminal 300*a* shown in FIG. 6, an elongate U-shaped incision is made in a base metal. A portion inside of the incision is bent into a mountainous shape to form a first spring portion 330*a* having a first contact 332*a* formed at the top of the mountainous shape. A portion outside of the incision is bent into a valley shape to form a second spring portion 340*a* having a second contact 342*a* formed at the bottom of the valley shape. In this case, the bending method for the first spring portion 330*a* and the second spring portion 340*a* can be changed according to the substrate or the like.

In the present embodiment, two spring portions are provided such that the first contact 332 and the second contact 342 are formed on the separate spring portions. However, only a single spring portion may be used. For example, both of the first contact 332 and the second contact 342 may be formed on a single spring portion having an S-shape as viewed along the X-direction. From the viewpoint of reduction in loss of a base sheet metal, however, it is preferable to provide a separate spring portion for each contact as in the terminal 300 of the present embodiment.

The terminal 300 has displacement prevention portions 350 projecting outward in the X-direction from each arm portion 304. The displacement prevention portions 350 serve to prevent displacement of the terminal 300 in the Y-direction which would be caused by forces urging the lamp 400.

As shown in FIG. 2, the housing 200 includes a first receptacle 210 and a second receptacle 220. The first receptacle 210 receives the first connection portion 310 of the terminal 300, and the second receptacle 220 receives the first spring portion 330 and the second spring portion 340 of the terminal 300. As can be seen from FIGS. 1 to 3, the fixed portion 320 of the terminal 300 is held between the first receptacle 210 and the second receptacle 220 in the housing 200.

As shown in FIG. 2, the first receptacle 210 has a front wall 212 with a concave portion 214 recessed in the Z-direction. As can be seen from FIGS. 1 and 2, the concave portion 214 is designed so as to be out of contact with the lamp 400 when the lamp 400 is held by the first connection portion 310 of the terminal 300. In the present embodiment, since the lamp 400 can be held solely by the terminal 300 as described above, the housing 200 does not need to support the lamp 400. With this configuration, deformation or discoloration of the housing 200 due to heat of the lamp 400 can be reduced. In the present embodiment, upper corners 216 of the concave portion 214 are chamfered in order to facilitate insertion of the lamp 400 into the terminal 300 for attachment of the lamp 400.

The housing 200 according to the present embodiment includes incorrect insertion prevention portions 230 projecting toward the interior of the first receptacle 210 along the X-direction. The illustrated incorrect insertion prevention portions 230 are formed by protrusions projecting in the X-direction. The incorrect insertion prevention portions 230 are located at a deviated position from the first connection portion 310 of the terminal 300 in the Y-direction. As can be seen from FIGS. 1 and 2, each of the incorrect insertion prevention portions 230 has an upper end located higher than an upper end of the first connection portion 310. Specifically, the ends of the incorrect insertion prevention portions 230 are located outside of the first connection portion 310 in the Z-direction. The incorrect insertion prevention portions 230 and the first connection portion 310 may be located at the same position in the Z-direction. In the present embodiment, the incorrect insertion prevention portions 230 are arranged such that a distance in the X-direction between the end of each incorrect insertion prevention portion 230 and the end of each elastic member of the first connection portion 310 is smaller than the radius of the lamp 400. With the aforementioned shape and arrangement of the incorrect insertion prevention portions 230, even if the lamp 400 is inserted into a displaced position in the X-direction when it is attached to the terminal 300, the lamp contact portion 410 is forced to move toward a space formed between the pair of the elastic members of the first connection portion 310. Thus, the lamp contact portion 410 is inserted between the pair of the elastic members of the first connection portion 310. Therefore, the lamp 400 is prevented from being incorrectly inserted between the terminal 300 and the housing 200. Furthermore, even if the lamp 400 is inserted into a displaced position in the Y-direction, the displacement of the lamp 400 is restricted in the Y-direction by abutment of the lamp contact portion 410 against the incorrect insertion prevention portions 230. Thus, the incorrect insertion prevention portions 230 serve to align the lamp contact portion 410 of the lamp 400 with the first connection portion 310 of the terminal 300 to ensure contact between the lamp contact portion 410 and the first connection portion 310.

As shown in FIG. 2, the housing 200 has insertion ports 240 and 250 formed in its front face. The second receptacle 220 communicates with an external space of the housing 200 through the insertion ports 240 and 250 in the Y-direction. Each of the insertion ports 240 and 250 has a rectangular shape as viewed along the Y-direction. An edge of the substrate 500 can be inserted into the insertion port 240 or 250 in the Y-direction (see FIG. 5D). In the present embodiment, the insertion ports 240 and 250 are provided so as to correspond to the first contact 332 and the second contact 342, respectively. The insertion ports 240 and 250 serve as a guide portion for guiding the substrate contact portion 520 of the substrate 500 for selectable connection of the substrate contact portion 520 of the substrate 500 with the first contact 332 or the second contact 342. Specifically, edges of each of the insertion ports 240 and 250 is chamfered in order to facilitate insertion of the edge of the substrate 500. In the present embodiment, the insertion ports 240 and 250 have a rectangular shape in order to enhance the guide function for preventing buckling of the first spring portion 330 or the second spring portion 340. However, for example, the insertion ports 240 and 250 may be connected to each other in the Z-direction so that an I-shaped port is formed as viewed along the Y-direction.

The connector 100 has a flange 260 provided on a peripheral portion of the housing 200. The flange 260 is located between the first receptacle 210 and the second receptacle 220. As shown in FIGS. 5A to 5D, the flange 260 is used for positioning of the connector 100 in the Z-direction when the connector 100 is inserted along the Z-direction into one of openings 610 formed in a sheet metal 600 of a liquid crystal panel.

The flange 260 of the present embodiment extends frontward (in the Y-direction) in particular to ensure a spatial distance and a creepage distance between the lamp contact portion 410 of the lamp 400 and the sheet metal 600 for preventing electric discharge from the lamp contact portion 410 to the sheet metal 600 when the connector 100 is mounted on the sheet metal 600. Thus, the flange 260 of the present embodiment also serves to prevent electric discharge.

The housing 200 of the present embodiment has stoppers 270 projecting in the X-direction from side surfaces of the housing 200. The stoppers 270 serve to prevent the connector 100 from being detached from the sheet metal 600 after the connector 100 has been attached to the sheet metal 600.

A process of incorporating the connector 100 in a backlight unit will be described briefly with reference to FIGS. 5A to 5D.

Figure 5A:
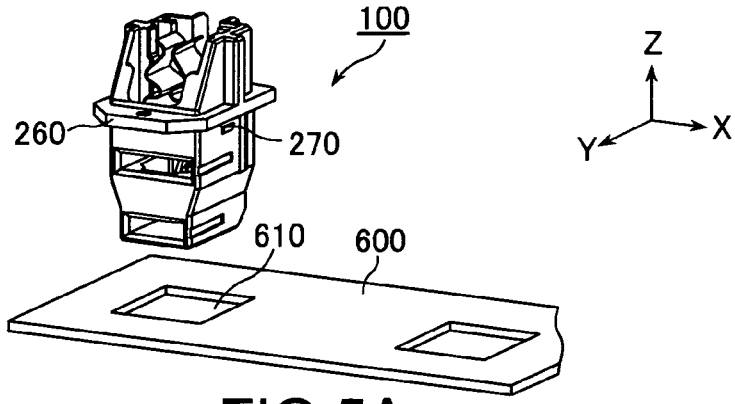
FIGS. 5A to 5D are perspective views showing an assembly process of a backlight unit including the connector shown in FIG. 1.
Figure 5B:
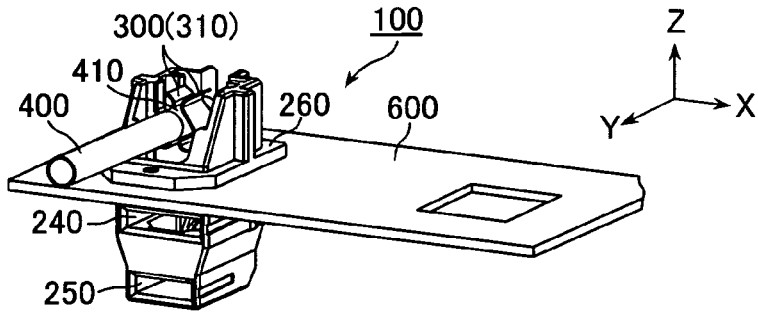

First, as shown in FIG. 5A, the connector 100 is inserted into the opening 610 of the sheet metal 600. As shown in FIG. 5B, the connector 100 is inserted in the opening 610 until the flange 260 is brought into contact with the sheet metal 600. At that time, the stoppers 270 are located below the sheet metal 600. Specifically, the sheet metal 600 is sandwiched in the Z-direction between the flange 260 and the stoppers 270. Thus, the connector 100 is fixed to the sheet metal 600.

Next, as shown in FIG. 5B, the lamp 400 is attached to the connector 100. At that time, the lamp 400 is held solely by the terminal 300 as described above and is not held in contact with the housing 200. Accordingly, problems, such as deformation of the housing 200 due to heat from the lamp 400, are reduced.

Figure 5C:
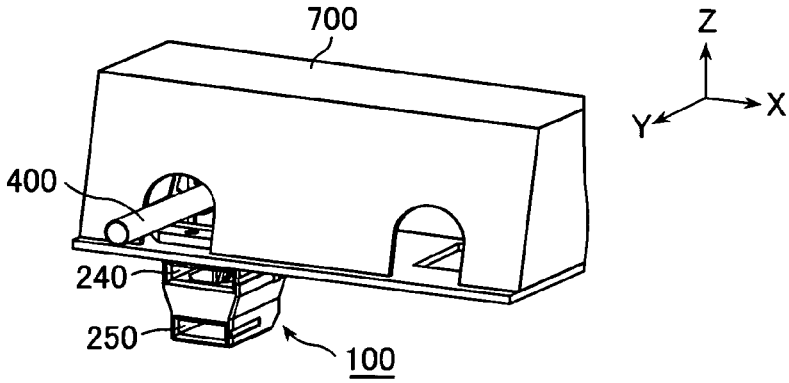
Figure 5D:
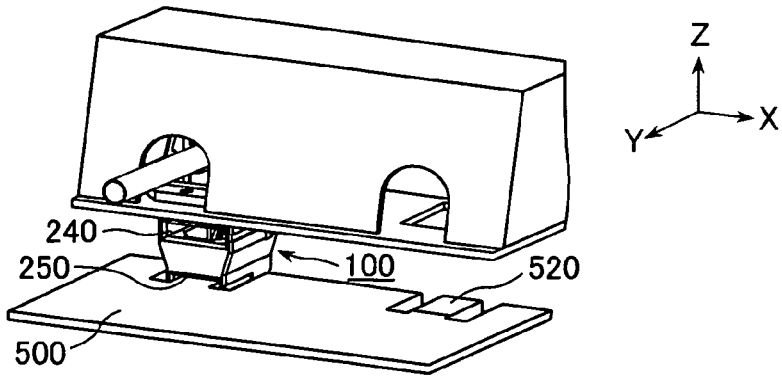

Then, as shown in FIG. 5C, a support cover 700 is provided above the connector 100 in order to prevent the lamp 400 from being released from the connector 100 by impact or the like.

Thereafter, as shown in FIG. 5D, the substrate contact portion 520 formed on the substrate 500 is inserted into the insertion port 250 along the Y-direction for establishing connection between the substrate 500 and the connector 100. In the illustrated example, the substrate contact portion 520 is formed on an upper surface of the substrate 500. Therefore, the substrate contact portion 520 of the substrate 500 is inserted in the lower insertion port 250 to locate the substrate 500 away from the sheet metal 600. However, the substrate 500 may be inserted in the upper insertion port 240 depending upon the specifications of the substrate 500 and the like. In other words, the connector 100 according to the present embodiment can establish connection with either the upper surface or the lower surface of the substrate 500. Thus, the connector 100 has an enhanced level of versatility.

In the above embodiment, the connector 100 has the first contact 332, the second contact 342, and the two insertion ports 240 and 250. However, the present invention is not limited to that example. The connector 100 may have three or more contacts and three or more insertion ports.

Second Embodiment

FIGS. 7 to 10 show a connector 100*b* according to a second embodiment of the present invention. As shown in FIGS. 7 to 10, the connector 100*b* has a housing 200*b* and a terminal 300*b* held by the housing 200*b*. In the connector 100*b* of the present embodiment, some modifications have been made to the housing 200 and terminal 300 of the connector 100 according to the first embodiment. The following description focuses on differences between the connector 100*b* and the connector 100.

Figure 7:
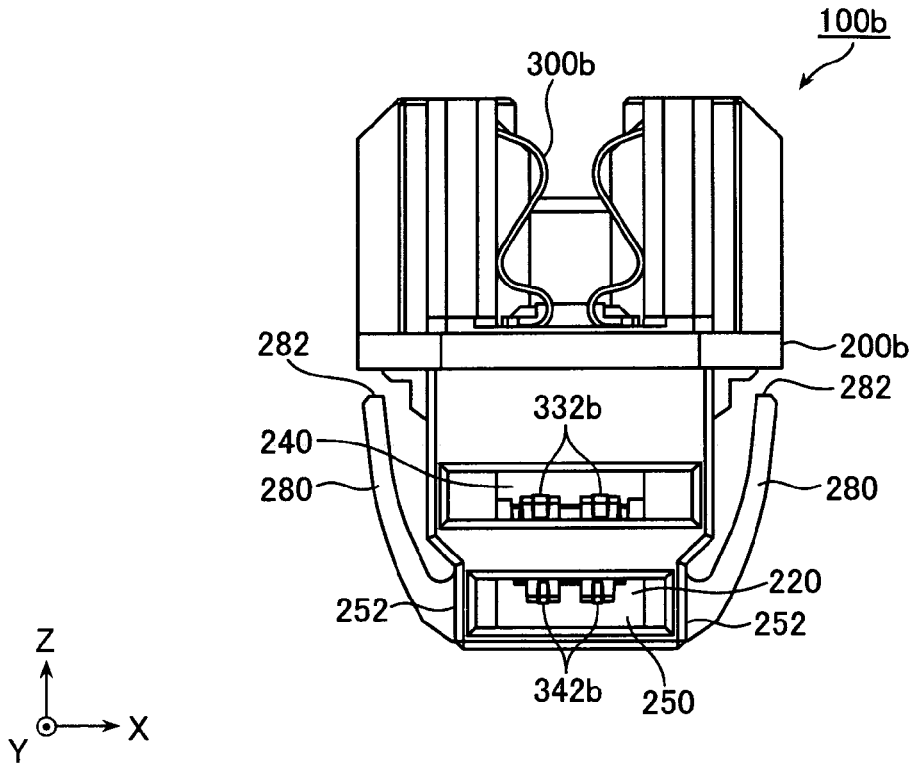
FIG. 7 is a front view showing a connector according to a second embodiment of the present invention.
Figure 8:
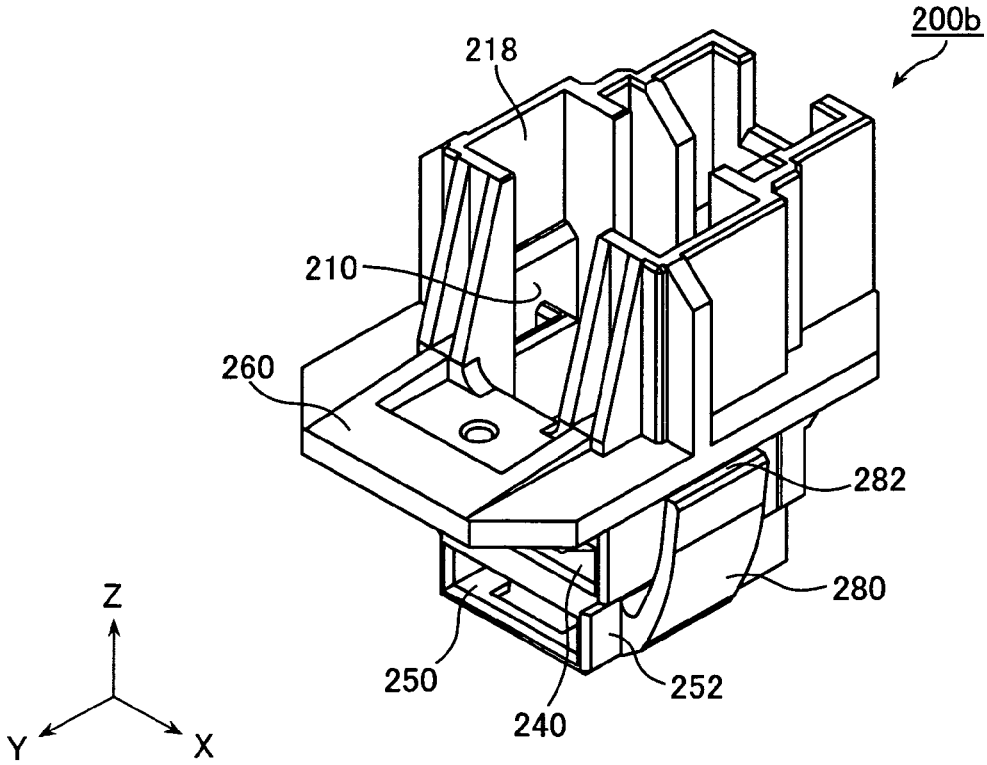
FIG. 8 is a perspective view showing a housing of the connector shown in FIG. 7.

As shown in FIGS. 7 and 8, the housing 200*b* includes a movement regulation portion 218 provided in the first receptacle 210 and elastic stoppers 280 for preventing detachment of the connector 100*b* from the sheet metal 600 in addition to the components of the housing 200 in the first embodiment.

The movement regulation portion 218 has portions recessed in the X-direction as viewed along the Z-direction. The length of the recessed portions in the Y-direction is substantially the same as the width of the first connection portion 310 of the terminal 300*b*, i.e., the length of the first connection portion 310 in the Y-direction. Therefore, when the terminal 300*b* is incorporated in the housing 200*b*, the movement regulation portion 218 can regulate movement of the first connection portion 310 in the Y-direction.

Figure 11:
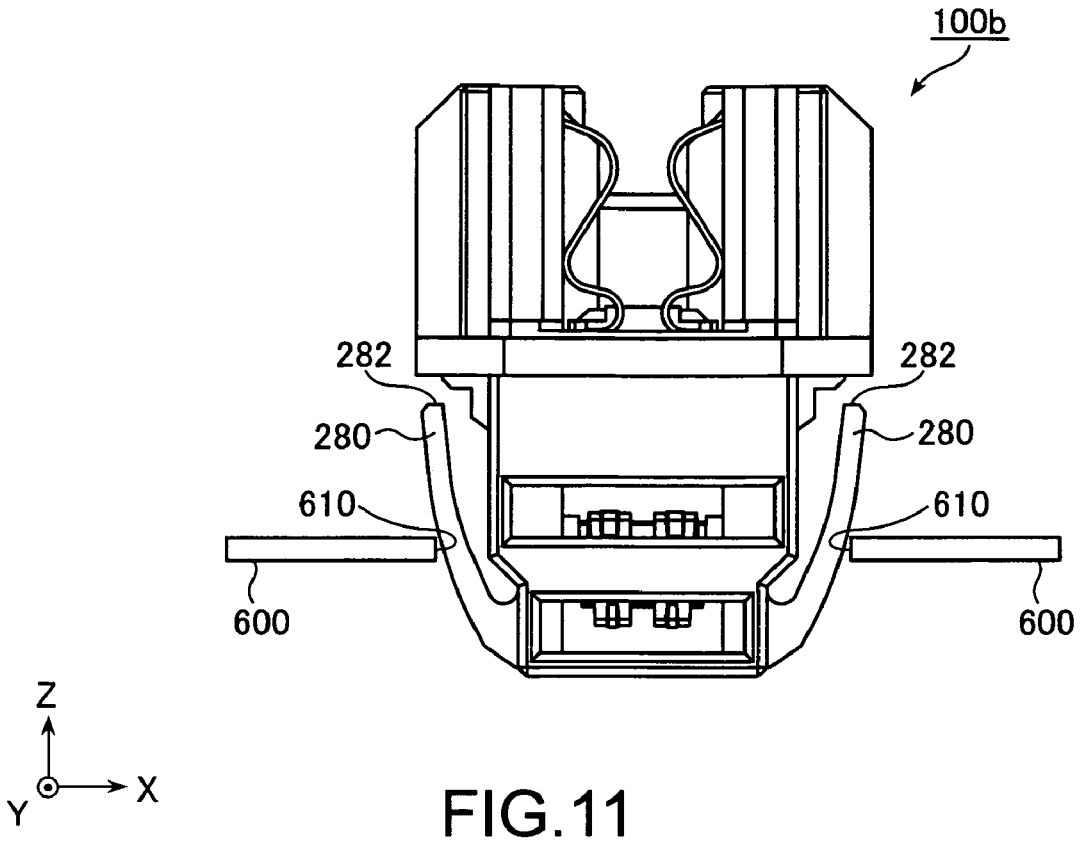
FIGS. 11 and 12 are front views explanatory of how to attach the connector shown in FIG. 7 to the sheet metal.
Figure 12:
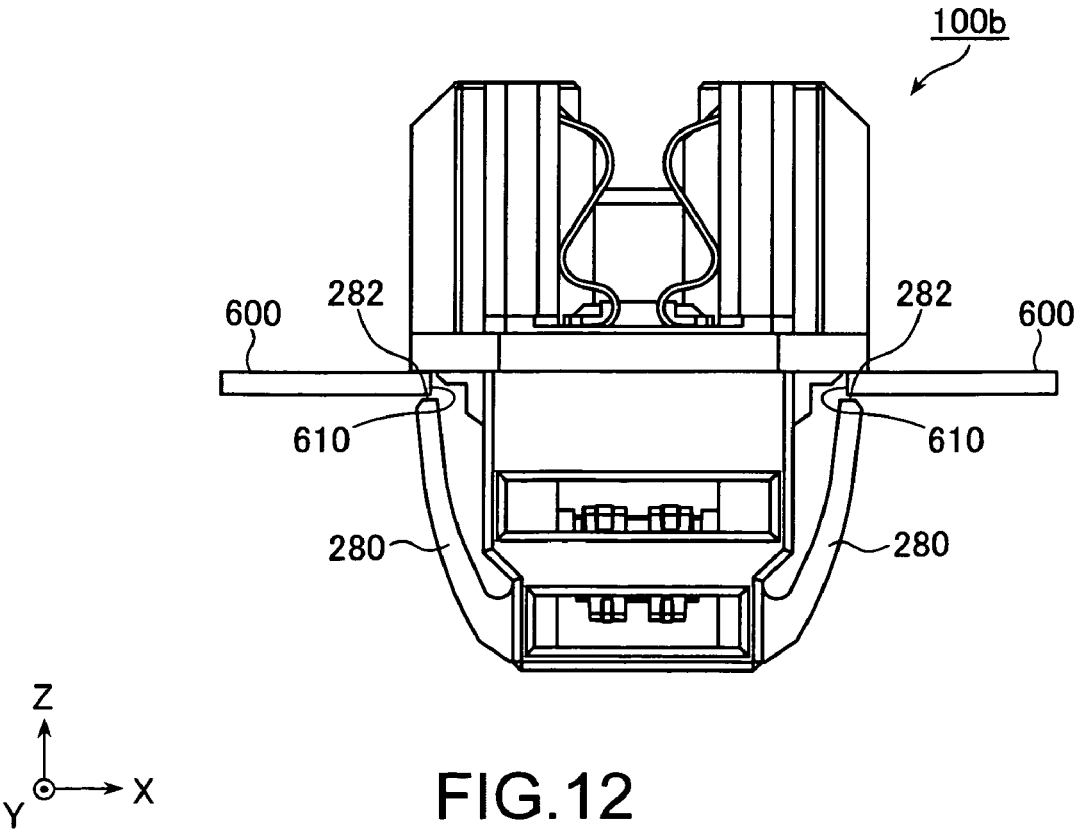

The elastic stoppers 280 of the present embodiment extend along the Z-direction from the vicinity of a lower end of the housing 200*b*, i.e., lateral portions 252 of the lower insertion port 250, and have a large spring length. With this configuration, the elastic stoppers 280 can deflect in the X-direction. As can be seen from FIGS. 10 to 12, each of the elastic stoppers 280 has an engagement end 282 for preventing detachment of the connector 100*b* from the sheet metal 600. When the connector 100*b* is attached to the sheet metal 600, the engagement ends 282 of the elastic stoppers 280 are held in abutment against the sheet metal 600. The engagement ends 282 may not necessarily be held in abutment against the sheet metal 600 when the connector 100*b* has been attached to the sheet metal 600 as long as they can prevent detachment of the connector 100*b* from the sheet metal 600. For example, the engagement ends 282 may be arranged such that slight gaps are formed between the engagement ends 282 and the sheet metal 600 when the connector 100*b* has been attached to the sheet metal 600.

The elastic stoppers 280 have advantages over the stoppers 270 of the connector 100 according to the first embodiment in that the connector 100*b* can repeatedly be attached to and detached from the sheet metal 600. Furthermore, since the elastic stoppers 280 of the present embodiment have a large spring length, they have excellent flexibility. Therefore, the elastic stoppers 280 are not shaved by edges of the opening 610 of the sheet metal 600 when the connector 100*b* is being attached to the sheet metal 600. Moreover, each of the elastic stoppers 280 extends from the base point, i.e., the lateral portion 252 of the present embodiment, to the engagement end 282 in a direction substantially parallel to a direction in which the connector 100*b* is inserted into the sheet metal 600. This configuration also contributes to preventing the elastic stoppers 280 from being shaved by the edges of the opening 610 in the sheet metal 600.

Figure 9:
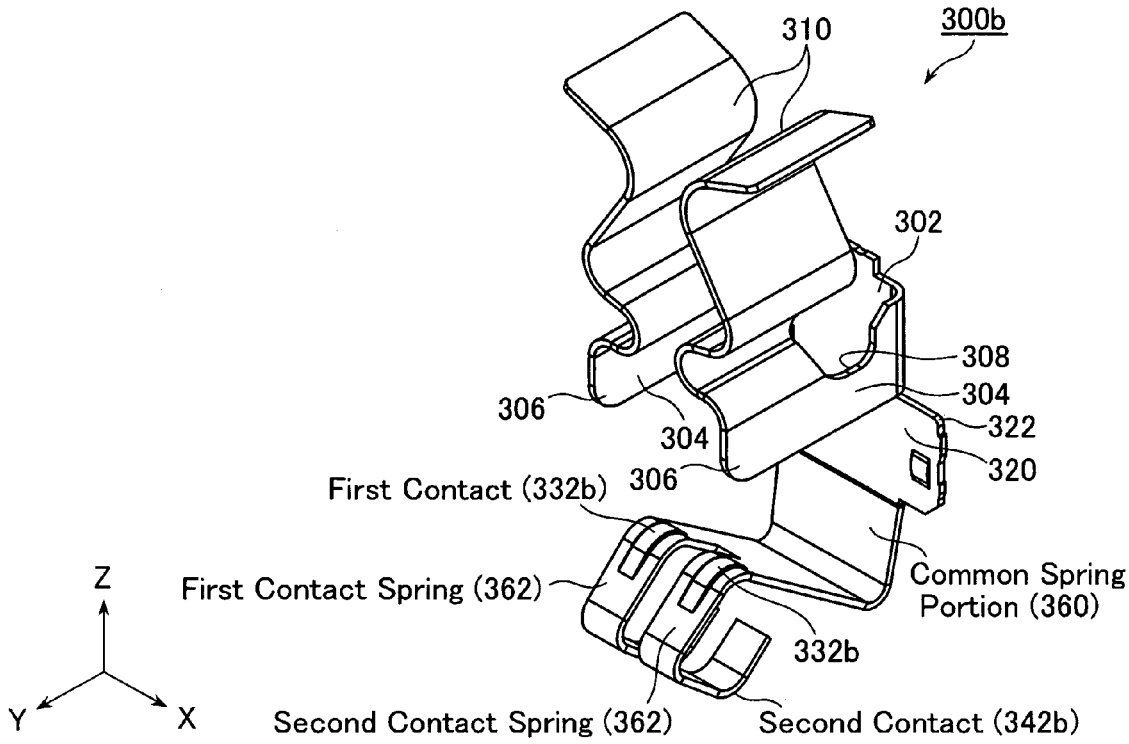
FIG. 9 is a perspective view showing a terminal of the connector shown in FIG. 7.
Figure 10:
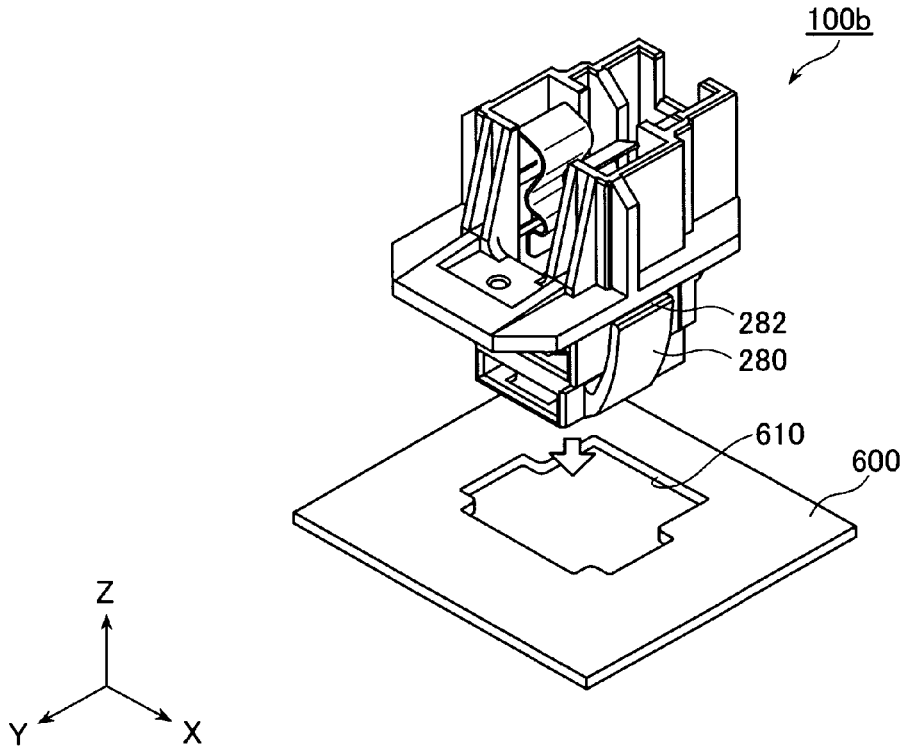
FIG. 10 is a perspective view explanatory of how to attach the connector shown in FIG. 7 to a sheet metal.

As shown in FIG. 9, in the terminal 300*b* of the present embodiment, some modifications have been made to the terminal 300 of the first embodiment for the following purposes: 1) prevention of electric discharge on the sheet metal 600 when the connector 100*b* is attached to the sheet metal 600, 2) increase of contact pressures applied to a target to be connected, such as the substrate 500, by a first contact 332*b* and a second contact 342*b*, and 3) reduction of stresses applied to the first connection portion 310 when the lamp is held by the first connection portion 310.

Among the three purposes, the first purpose is accomplished by eliminating portions on which electric fields would concentrate near the sheet metal 600 when the connector 100*b* is attached to the sheet metal 600. Specifically, front corners 306 of the arm portions 304 are rounded into an R-shape so as to prevent electric fields from concentrating on the corners 306. Similarly, corners 322 of the fixed portion 320 are also rounded into an R-shape so as to prevent electric fields from concentrating on the corners 322. Furthermore, since the movement regulation portion 218 is provided in the housing 200*b* as described above, the displacement prevention portions 350 of the first embodiment can be eliminated to reduce the possibility of electric discharge.

The second purpose is accomplished by using a common spring portion 360 having a large spring width for larger contact pressures and two contact spring portions 362 extending from the common spring portion 360 instead of using the spring portions pronged from the fixed portion 320. The first contact 332*b* and the second contact 342*b* are provided on the two contact spring portions 362, respectively. More specifically, the common spring portion 360 is formed by a single spring element extending from the fixed portion 320 and bent into a shape resembling a V-shape or a shape resembling an L-shape as viewed along the X-direction. The two contact spring portions 362 extend from an end of the common spring portion 360. The contact spring portions 362 are curved into a shape resembling a C-shape as viewed along the X-direction. With this configuration, the first contact 332*b* and the second contact 342*b* can be brought into contact with the substrate 500 under greater contact pressures as compared to the connector 100 of the first embodiment.

The third purpose is accomplished by forming an R-shaped concave portion 308 in each arm portion 304 for stress reduction. More specifically, the R-shaped concave portion 308 is a rounded and recessed portion. Each of the R-shaped concave portions 308 is formed in the arm portion 304 between a base of the elastic member of the first connection portion 310 and the base portion 304. In other words, each R-shaped concave portion 308 is formed between the base portion 304 and an intersection of two lines forming an L-shape with the arm portion 304 and the elastic member of the first connection portion 310, as viewed along the X-direction. With this configuration, stresses applied to the first connection portion 310 can be absorbed by the arm portions 304.

Third Embodiment

Figure 13:
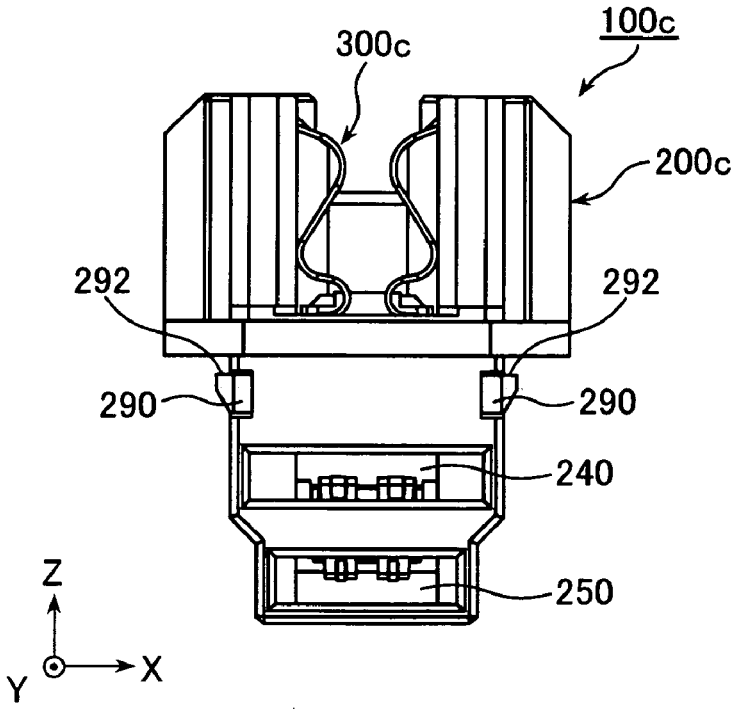
FIG. 13 is a front view showing a connector according to a third embodiment of the present invention.
Figure 14:
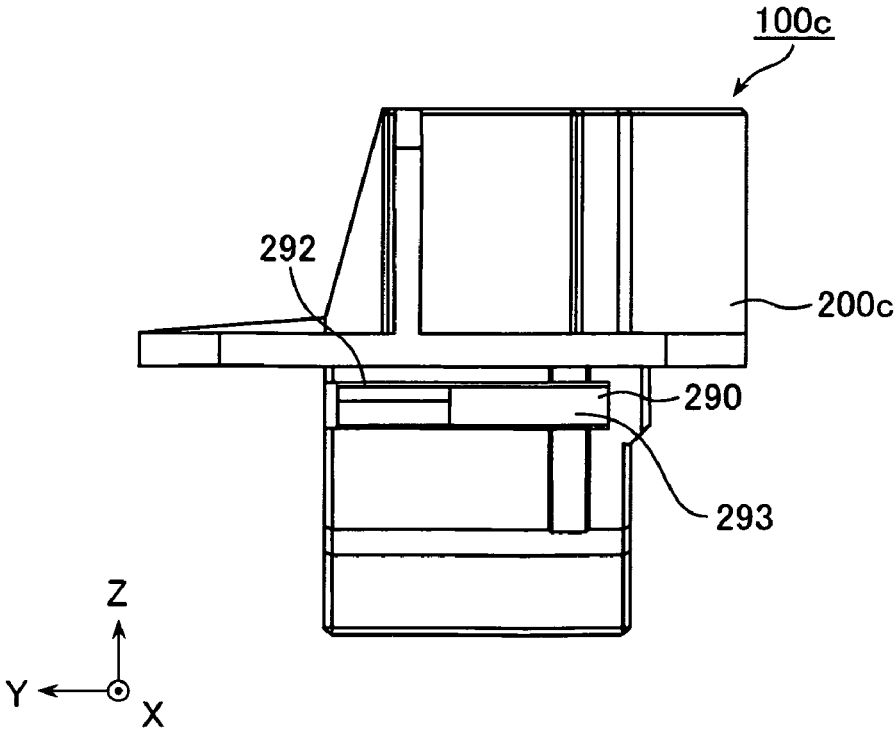
FIG. 14 is a side view showing the connector of FIG. 13.

FIGS. 13 and 14 show a connector 100*c* according to a third embodiment of the present invention. As shown in FIGS. 13 and 14, the connector 100*c* includes a housing 200*c* and a terminal 300*c*. The connector 100*c* is a variation of the connector 100*b* of the second embodiment. The terminal 300*c* has the same structure as the terminal 300*b*. The following description focuses on differences between the housing 200*c* and the housing 200*b* of the second embodiment.

Figure 15:
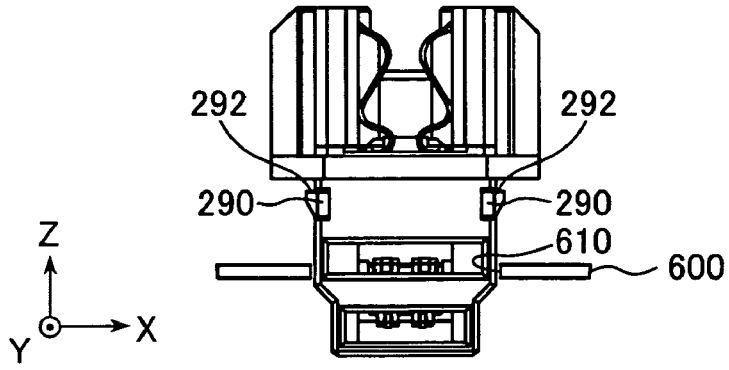
FIGS. 15 to 17 are front views explanatory of how to attach the connector shown in FIG. 13 to a sheet metal.
Figure 16:
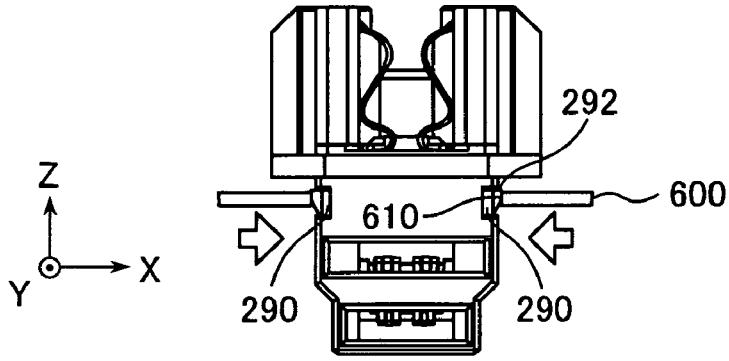
Figure 17:
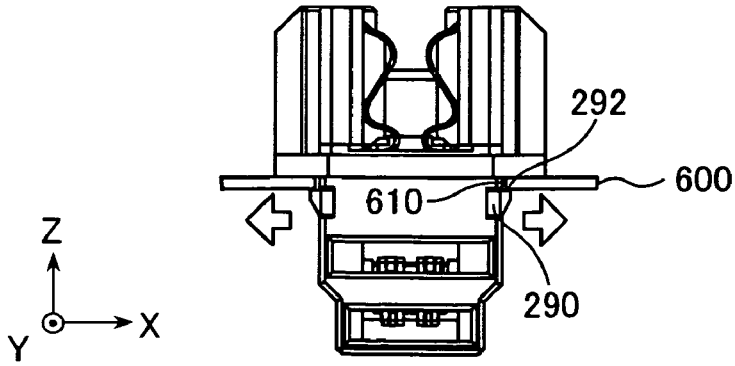

While the housing 200*b* of the second embodiment has the elastic stoppers 280 extending primarily along the Z-direction, the housing 200*c* of the present embodiment has elastic stoppers 290 extending along the Y-direction. Each of the elastic stoppers 290 has an engagement end 292 and a fixed end 293 along the Y-direction. As can be seen from FIGS. 15 to 17, the engagement end 292 of each elastic stopper 290 is configured to be movable in the X-direction with the fixed end 293 as the fulcrum. Thus, the engagement end 292 of each elastic stopper 290 can deflect in the X-direction.

Those elastic stoppers 290 can have a great spring length using the length of the housing 200*c* in the Y-direction. As the result, the elastic stoppers 290 can have excellent flexibility. Therefore, the elastic stoppers 290 are prevented from being shaved by the sheet metal 600 as in the case of the elastic stoppers 280 according to the second embodiment. Furthermore, the connector 100*c* can repeatedly be attached to and detached from the sheet metal 600.

As described above, according to the embodiments of the present invention, a plurality of contacts for selectable connection are provided at different heights. Therefore, a single connector can deal with different distances between a substrate and a sheet metal to which the connector is attached.

A connector may be configured to hold a lamp extending in a first direction. The connector may be attached to a sheet metal for use. The connector may have a terminal including a first connection portion configured to establish connection with a lamp contact portion formed on the lamp and a housing configured to hold the terminal. The housing has an elastic stopper including an engagement end for preventing detachment of the connector from the sheet metal once the connector is attached to the sheet metal. A base and the engagement end of the elastic stopper may be located on the same side of the sheet metal to which the connector has been attached.

The present application is based on a Japanese patent application of JP2008-171997 filed before the Japan Patent Office on Jul. 1, 2008 and a Japanese patent application of JP2009-120622 filed before the Japan Patent Office on May 19, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector configured to hold a lamp extending in a first direction, the connector comprising:

a housing; and a terminal including:

(i) a first connection portion configured to establish connection with a lamp contact portion formed on the lamp, (ii) a second connection portion including a first contact and a second contact located at different positions in a second direction perpendicular to the first direction, and (iii) a fixed portion pressed in the housing along the second direction and located between the first connection portion and the second connection portion in the second direction;

wherein the first contact and the second contact of the second connection portion are configured to establish selectable connection with a substrate contact portion formed on a substrate;

wherein the housing includes a guide portion configured to guide the substrate contact portion of the substrate for establishing selectable connection between the substrate contact portion and the first contact or the second contact; and wherein the guide portion includes:

a first insertion port configured to allow the substrate contact portion to be inserted along the first direction for establishing connection with the first contact of the terminal; and a second insertion port configured to allow the substrate contact portion to be inserted along the first direction for establishing connection with the second contact of the terminal.

2. The connector as recited in claim 1, wherein the terminal further includes:

a first spring portion extending from the fixed portion, the first contact being provided on the first spring portion; and a second spring portion extending from the fixed portion, the second contact being provided on the second spring portion.

3. The connector as recited in claim 1, wherein the fixed portion has at least one rounded corner.

4. The connector as recited in claim 1, wherein the housing includes an elastic stopper for engaging with a sheet metal to prevent detachment of the connector from the sheet metal, the sheet metal having an opening in which the connector is inserted in the second direction.

5. The connector as recited in claim 4, wherein the housing includes a flange located between the first connection portion and the second connection portion in the second direction, wherein the elastic stopper is located between the flange and the second connection portion in the second direction.

6. The connector as recited in claim 5, wherein the elastic stopper is deflectable in a third direction perpendicular to both of the first direction and the second direction and extends in the first direction.

7. The connector as recited in claim 1, wherein the first connection portion includes a pair of elastic members opposed to each other in a third direction perpendicular to both of the first direction and the second direction so as to hold the lamp contact portion of the lamp therebetween.

8. The connector as recited in claim 7, wherein the first connection portion is configured to have at least three contact points with the lamp contact portion of the lamp.

9. The connector as recited in claim 7, wherein the housing includes:

a receptacle configured to receive the first connection portion; and an incorrect insertion prevention portion extending toward an interior of the receptacle in the third direction.

10. The connector as recited in claim 9, wherein the incorrect insertion prevention portion comprises a protrusion projecting in the third direction, the protrusion being located at a deviated position from the first connection portion in the first direction.

11. The connector as recited in claim 10, wherein:

the incorrect insertion prevention portion has an end aligned with or positioned outside of the first connection portion in the second direction; and a distance in the third direction between the end of the projection and an end of the elastic member of the first connection portion is smaller than a radius of the lamp.

12. The connector as recited in claim 7, wherein the terminal further includes:

a base portion extending from the fixed portion; and a pair of arm portions extending along the first direction from both ends of the base portion in the third direction to the first connection portion, the arm portion having a front corner rounded in the first direction, wherein the arm portion and the elastic member of the first connection portion form a shape resembling an L-shape as viewed along the third direction.

13. The connector as recited in claim 12, wherein each of the pair of arm portions includes a rounded concave portion formed between a base of the elastic member of the first connection portion and the base portion.

14. A connector configured to hold a lamp extending in a first direction, the connector comprising:

a housing; and a terminal including:

(i) a first connection portion configured to establish connection with a lamp contact portion formed on the lamp, (ii) a second connection portion including a first contact and a second contact located at different positions in a second direction perpendicular to the first direction, and (iii) a fixed portion pressed in the housing along the second direction and located between the first connection portion and the second connection portion in the second direction;

wherein the terminal further includes:

a common spring portion extending from the fixed portion so as to be bent into a shape resembling a V-shape or a shape resembling an L-shape as viewed along a third direction perpendicular to both of the first direction and the second direction;

a first contact spring portion extending from an end of the common spring portion, the first contact being provided on the first contact spring portion; and a second contact spring portion extending from the end of the common spring portion, the second contact being provided on the second contact spring portion.

15. The connector as recited in claim 14, wherein the first contact spring portion and the second contact spring portion have a shape resembling a C-shape as viewed from the third direction.

16. A backlight assembly comprising:

a lamp extending in a first direction;

a connector configured to hold the lamp, the connector including:

(i) a housing including a guide portion including:

a first insertion port; and a second insertion port; and (ii) a terminal including:

(a) a first connection portion configured to establish connection with a lamp contact portion formed on the lamp, (b) a second connection portion including a first contact and a second contact located at different positions in a second direction perpendicular to the first direction, and (c) a fixed portion pressed in the housing along the second direction and located between the first connection portion and the second connection portion in the second direction; and a substrate having a substrate contact portion connected to the first contact or the second contact of the connector;

wherein the guide portion of the housing is configured to guide the substrate contact portion of the substrate for establishing connection between the substrate contact portion and the first contact or the second contact;

wherein the first insertion port of the guide portion is configured to allow the substrate contact portion to be inserted along the first direction for establishing connection with the first contact of the terminal; and wherein the second insertion port of the guide portion is configured to allow the substrate contact portion to be inserted along the first direction for establishing connection with the second contact of the terminal.

17. A connector configured to hold a lamp extending in a first direction, the connector comprising:

a housing; and a terminal including:

(i) a first connection portion configured to establish connection with a lamp contact portion formed on the lamp, (ii) a second connection portion including a first contact and a second contact located at different positions in a second direction perpendicular to the first direction, and (iii) a fixed portion pressed in the housing along the second direction and located between the first connection portion and the second connection portion in the second direction;

wherein the housing includes an elastic stopper for engaging with a sheet metal to prevent detachment of the connector from the sheet metal, the sheet metal having an opening in which the connector is inserted in the second direction;

wherein the housing includes a flange located between the first connection portion and the second connection portion in the second direction, wherein the elastic stopper is located between the flange and the second connection portion in the second direction; and wherein the elastic stopper is deflectable in a third direction perpendicular to both of the first direction and the second direction and extends from an end of the housing in the second direction.

* * * * *